US009961936B2

(12) United States Patent
Grzonka et al.

(10) Patent No.: US 9,961,936 B2
(45) Date of Patent: May 8, 2018

(54) MULTI-FILTER FOR A SMOKING PRODUCT

(75) Inventors: Horst Grzonka, Mistelgau (DE); Markus Schosnig, Bindlach (DE); Eduard Nica, Ploesti (RO); Paulo Oliveira, Rio de Janeiro (BR); John Richardson, Eastleigh Hampshire (GB); Martin Graham Duke, Eastleigh Hants (GB); Maya Nikolaeva, Moscow (RU)

(73) Assignee: BRITISH AMERICAN TOBACCO (GERMANY) GMBH, Hamburg (DE)

( * ) Notice: Subject to any disclaimer, the term of this patent is extended or adjusted under 35 U.S.C. 154(b) by 672 days.

(21) Appl. No.: 13/128,428

(22) PCT Filed: Nov. 4, 2009

(86) PCT No.: PCT/EP2009/064611

§ 371 (c)(1),
(2), (4) Date: Nov. 16, 2011

(87) PCT Pub. No.: WO2010/052238

PCT Pub. Date: May 14, 2010

(65) Prior Publication Data

US 2012/0055496 A1 Mar. 8, 2012

(30) Foreign Application Priority Data

Nov. 10, 2008 (DE) ..... 10 2008 056 384

(51) Int. Cl.
*A24D 3/04* (2006.01)

(52) U.S. Cl.
CPC ..... *A24D 3/048* (2013.01); *A24D 3/043* (2013.01)

(58) Field of Classification Search
CPC ..... A24D 3/048; A24D 3/043
See application file for complete search history.

(56) References Cited

U.S. PATENT DOCUMENTS 3,768,489 A * 10/1973 Kiefer et al. ..... 131/340
4,020,751 A 5/1977 Greve et al.
4,434,805 A * 3/1984 Hall ..... 131/362
4,708,150 A 11/1987 Lamb et al.
5,927,287 A 7/1999 Matsumura et al.
(Continued)

FOREIGN PATENT DOCUMENTS

CN 1131004 A 9/1996
CN 2650519 Y 10/2004
(Continued)

OTHER PUBLICATIONS

International Search Report corresponding to PCT/EP2009/064611 dated Mar. 1, 2010.
(Continued)

*Primary Examiner* — Michael H Wilson
*Assistant Examiner* — Dionne Walls Mayes
(74) *Attorney, Agent, or Firm* — Cantor Colburn LLP

(57) ABSTRACT

Filter for a smoking product, the filter including a first filter segment and a second filter segment, wherein the first filter segment includes a component that is given off into a smoke stream passing through a filter outlet opening, and the second filter segment includes a sorption means that absorbs a component from a smoke stream passing through the filter inlet opening.

15 Claims, 1 Drawing Sheet

(56) References Cited

U.S. PATENT DOCUMENTS

| | | | | |
|---|---|---|---|---|
| 6,059,706 | A | 5/2000 | Chehab et al. | |
| 6,202,650 | B1 * | 3/2001 | Kaneki et al. | A24D 3/043 131/335 |
| 7,381,277 | B2 * | 6/2008 | Gonterman et al. | A24D 3/14 131/274 |
| 2007/0000505 | A1 | 1/2007 | Zhuang et al. | |
| 2007/0261706 | A1 * | 11/2007 | Banerjea et al. | 131/342 |
| 2008/0029114 | A1 * | 2/2008 | Seitert et al. | A24D 3/048 131/335 |
| 2008/0053469 | A1 | 3/2008 | Paine et al. | |
| 2008/0314401 | A1 * | 12/2008 | McLaughlin et al. | A24D 3/041 131/335 |

FOREIGN PATENT DOCUMENTS

| | | | |
|---|---|---|---|
| CN | 101049187 | A | 10/2007 |
| DE | 2452749 | A1 | 5/1976 |
| DE | 19751598 | A1 | 5/1999 |
| DE | 60008998 | T2 | 1/2005 |
| EP | 0558166 | A2 | 9/1993 |
| EP | 558166 | A2 | 9/1993 |
| EP | 1093728 | A1 | 4/2001 |
| EP | 1 129 631 | A1 | 9/2001 |
| EP | 1321050 | A1 | 6/2003 |
| EP | 1 688 052 | A1 | 8/2006 |
| EP | 1 797 780 | A1 | 6/2007 |
| EP | 1797780 | A1 | 6/2007 |
| EP | 1797780 | A1 | 6/2007 |
| EP | 1889550 | A1 | 2/2008 |
| EP | 1972213 | A1 | 9/2008 |
| JP | 11-069965 | A | 3/1999 |
| JP | 2005-525795 | A | 9/2005 |
| JP | 2008-528051 | A | 7/2008 |
| RU | 2 214 142 | C2 | 10/2003 |
| RU | 2 233 602 | C2 | 8/2004 |
| WO | WO 00/25611 | A1 | 5/2000 |
| WO | WO 02/069745 | A1 | 9/2002 |
| WO | 03039276 | A1 | 5/2003 |
| WO | 03/059096 | A1 | 7/2003 |
| WO | 2004066761 | A1 | 8/2004 |
| WO | 2006082525 | A1 | 8/2006 |
| WO | WO 2007/068309 | * | 6/2007 |
| WO | 2008015570 | A2 | 2/2008 |

OTHER PUBLICATIONS

English translation of International Search Report with Annexes corresponding to PCT/EP2009/064611 with Veritfication of Translation.

Office Action, dated Aug. 6, 2013, for JP 2011-535104, filed Nov. 4, 2009.

Office Action dated Mar. 15, 2013 for Russian Patent Application No. 2011 123 092, with German translation and Machine Translation into English.

English translation of Office Action issue by State Intellectual Property Office, P.R. China dated Sep. 6, 2013 to patent application No. 200980144430.8, filed Nov. 4, 2009.

"Final Decision" Office Action, dated Dec. 5, 2013, for corresponding Russian patent application No. 2011123092. [with German Translation and machine translation into English].

German Office Action dated Apr. 28, 2014 for corresponding German Patent Application No. 10 2008 056 384.6 [with machine translation into English].

First Office Action issued by the State Intellectual Property Office, P.R. China dated Feb. 16, 2013 for Application No. 200980144430.8, filed Nov. 4, 2009.

International Preliminary Report on Patentability (with English translation), dated May 10, 2011, for International Application PCT/EP2009/064611, filed Nov. 4, 2009.

Written Opinion of the International Search Authority (with English translation), dated May 10, 2011, for International Application PCT/EP2009/064611, filed Nov. 4, 2009.

Office Action, dated Sep. 11, 2012, for Russian Application No. 2011 123 092.

Office Action, dated Dec. 24, 2014, for JP 2013-252218, referencing JP 2008-528051 and JP 2005-525795 (with machine translations attached), as well as other previously submitted references or equivalents (2004-535158 corresponds to previously-submitted WO0269745, 2008-35861 corresponds to previously-submitted EP1889550, and 5-336943 corresponds to previously-submitted EP0558166).

Patent Examination Report No. 1, issued by Australian Patent Office dated Jun. 19, 2012 for Application No. 2009312803, filed Nov. 4, 2009, citing EP1797780 and DE0558166 (EP0558166).

Notice of Acceptance issued by Australian Patent Office dated Jun. 27, 2013 for Application No. 2009312803, filed Nov. 4, 2009.

Notice of Grant issued by Australian Patent Office dated Oct. 24, 2013 for Application No. 2009312803, filed Nov. 4, 2009.

* cited by examiner

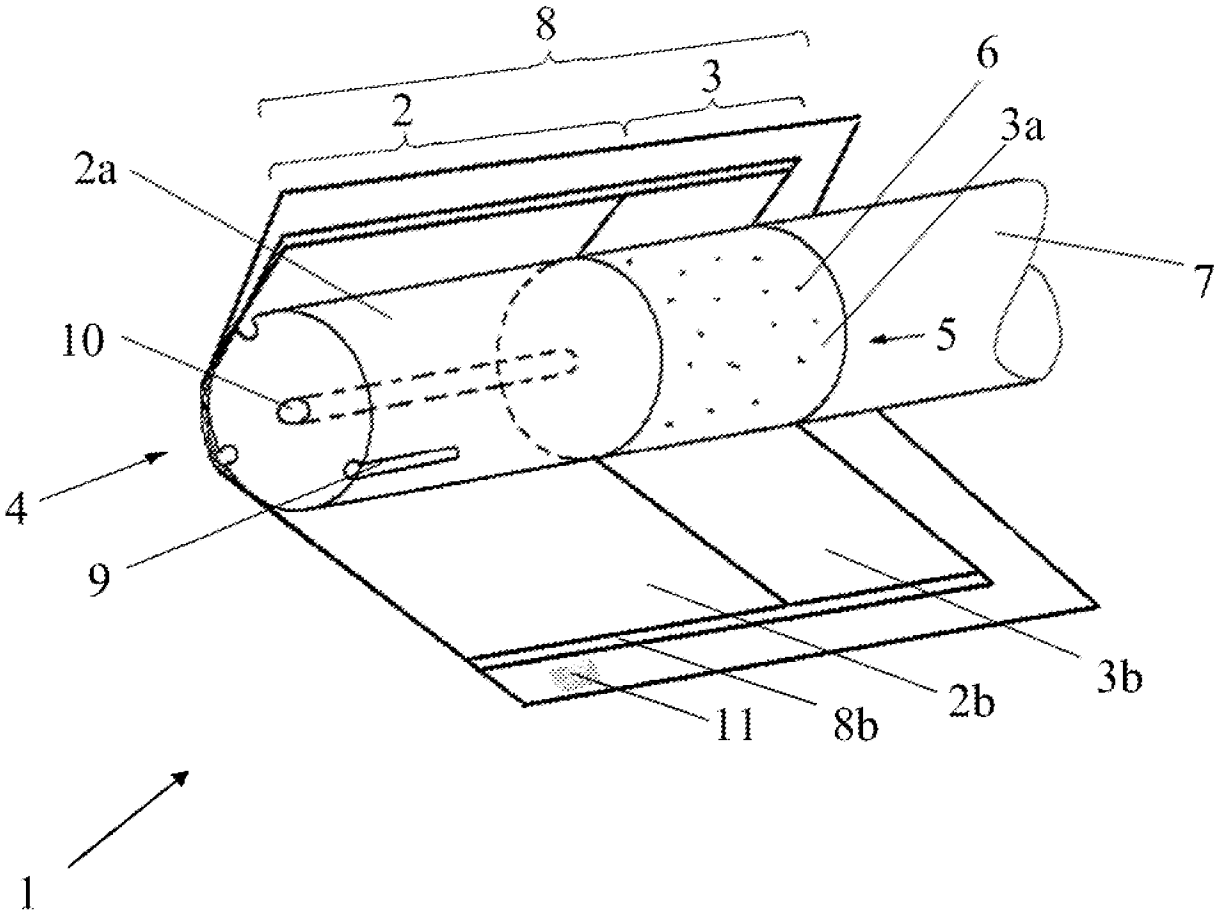
7
3a
6
5
3b
2b
8b
11
3
8
2
2a
10
4
9
1

MULTI-FILTER FOR A SMOKING PRODUCT

CLAIM FOR PRIORITY

This application is a National Stage Entry entitled to and hereby claims priority under 35 U.S.C. § § 365 and 371 to corresponding PCT Application No. PCT/EP2009/064611, filed Nov. 4, 2009, which in turn claims priority to German Application Serial No. DE 102008056384.6, filed Nov. 10, 2008. The entire contents of the aforementioned applications are herein expressly incorporated by reference.

The invention relates to a ventilated multi-filter for a smoking product, comprising at least two filter segments, wherein at least one filter segment comprises a component to be dispensed to the smoke flow and at least one other filter segment comprises a sorption agent which sorbs at least one component of the smoke flow, and at least one filter segment comprises at least one recess on its circumferential area.

Cigarette filters are known in the prior art which are for example provided with activated carbon particles which sorb undesirable substances from the cigarette smoke, wherein it is possible for particular substances which are desirable in the cigarette smoke, such as for instance flavour additives, to disadvantageously also be removed from the cigarette smoke. This can negatively impair the taste of the cigarette.

It is the object of the present invention to provide a filter for a smoking product and also a method for manufacturing the same, wherein the filter removes undesirable components from the smoke flow but does not impair the taste of the smoking product.

This object is solved by the subjects of claims 1 and 13. The sub-claims define preferred embodiments of the present invention.

The smoking product filter in accordance with the invention comprises at least two filter segments, wherein the first filter segment comprises a component which is dispensed to a smoke flow which passes through a filter outlet opening, wherein a second filter segment comprises a sorption agent which sorbs at least one component from a smoke flow which passes through a filter inlet opening. In this context, "sorb" is intended to be understood to mean both depositing the component on the sorption agent (adsorption) and assimilating the component in the sorption agent (absorption). In its broadest sense, "sorption" is intended to refer to any bonding, by the sorption agent, of the component to be removed. Thus, a filter segment is impregnated with a sorption agent and/or substance, such that one or more undesirable components are completely or partially removed or "filtered out" from the smoke flow. However, it is often then unavoidable that desired components or substances—for example, flavour additives—are also removed from the smoke flow along with the undesirable components or substances, such that the taste of the cigarette is negatively impaired. To this end, the filter in accordance with the invention comprises another segment comprising one or more components which is/are supplied and/or dispensed to the smoke flow. Flavour additives which are removed from the smoke flow along with the undesirable components can thus in particular be subsequently re-added to the smoke flow, so as not to negatively impair the original taste of the smoking product.

It is however also conceivable for other or equivalent substances to be added. These substances can also be added in any amount, i.e. in a lower or higher concentration than the original concentration of said substance in the smoke flow. It is perfectly conceivable for the filter in accordance with the invention to comprise a number of segments which all dispense one or more identical substances or respectively different substances to the smoke flow. It is also conceivable for the filter in accordance with the invention to comprise a number of segments which "filter out" one or more or respectively different undesirable components from the smoke flow. The number of segments is thus not limited to two segments, but rather the filter can also perfectly well comprise a number of identical or different segments which respectively sorb substances from the smoke flow or dispense substances to the smoke flow.

In one preferred embodiment, the filter comprises two filter segments, wherein the first is a filter segment which comprises a component to be dispensed to the smoke flow and the second is a filter segment which comprises a sorption agent which can sorb one or more components from the smoke flow. In this case, the first filter segment should be arranged in a region of the filter which faces away from the smokable material, i.e. the tobacco rod, while the second filter segment is arranged in a region of the filter which faces the smokable material of the smoking product. In other words, the second filter segment is arranged between the tobacco rod and the first filter segment. Thus, the smoke flow coming from the smokable material is firstly guided through the second filter segment and purged of undesirable components, wherein the smoke flow then passes through the first filter segment in which it is then impregnated with a desired component, before it finally exits the smoking product. The reverse case is of course also conceivable, namely that the unfiltered smoke flow is firstly impregnated with a component to be added, and undesirable components are only then removed from the smoke flow. This could for example be the case when the sorption agent which sorbs the undesirable components in the second filter segment can only sorb a particular proportion of desired components of the smoke flow, such that after the smoke flow has been filtered, a sufficiently high proportion of one or more desired components of the smoke flow is still present.

In another preferred embodiment, the first filter segment—i.e. the filter segment which comprises the component to be supplied—comprises one or more recesses. These recesses can serve to guide ventilation air and can be arranged in a uniform distribution on the outer circumference of the first filter segment and extend parallel to the longitudinal axis of the first filter segment. It is however also conceivable for the recesses to extend in a gentle spiral shape on the outer circumference of the first filter segment. It is also conceivable for the second filter segment to also comprise such recesses, i.e. for the recesses to extend over both filter segments.

The recesses can be shaped as grooves on the outer circumference of the filter and preferably extend from the end of the filter facing the smoker and/or the filter outlet opening into the filter, in particular up to a region in the first filter segment.

The first filter segment also preferably comprises a region or element comprising a component to be dispensed to the smoke flow. Thus, the first filter segment can be impregnated with the component to be dispensed or the component to be dispensed can be distributed over at least a part of the first filter segment.

In a particularly preferred embodiment, the first filter segment comprises an elongated element which is arranged on the central longitudinal axis of the first filter segment and comprises the component to be dispensed. This can in particular be a so-called flavour thread which has been treated with a flavouring substance. As they pass or flow through the first filter segment, the substances to be dispensed which are present in the flavour thread are dispensed to the smoke flow, wherein the recesses—in particular, on the circumference of the first filter segment—fulfil an additional function, namely that of concentrating the smoke flow towards the flavour thread, such that the substances to be dispensed can be optimally dispensed to the smoke flow.

In another preferred embodiment, the sorption agent in the second filter segment is an adsorption agent, for example activated carbon, wherein the activated carbon can be distributed over the entire second filter segment in the form of granules or particles.

It is also conceivable for both the first and the second filter segment to each comprise a filter base element and a base wrapping, wherein the filter base elements are manufactured from cellulose acetate tow and are each provided with a wrapping, for example a paper material, on their circumference. The wrappings can in particular be glued to the filter base elements, once the filter base elements have been placed in succession in accordance with a desired arrangement.

It is also possible to arrange another filter wrapping, in particular glued, on the outer circumference of the base wrappings of the first and second filter segment. It is thus possible for said wrappings to be able to achieve a dimensionally stable wrapping of the filter, wherein a dimensionally stable wrapping is specifically desired in the region of the filter segment comprising the recesses and/or grooves on its outer circumference, in order to ensure a permanent dimensional stability of the recesses and/or grooves in the first filter segment.

It is particularly advantageous for a dimensionally stable wrapping of the filter if the base wrappings are glued to the filter base elements over an area, and if the filter wrapping is glued to the base wrappings over an area. Once cured, the glue connection between the wrappings and the filter base elements then forms a dimensionally stable wrapping of the filter, wherein it is advantageous if the glue connections extend over a large area of the circumference of the filter segments. In a preferred case, the glue connections extend over 80% to 95% of the circumferential area of the filter segments and/or the filter.

Furthermore, the mass of the quantity of glue which is used for gluing the filter base segments to the base wrappings and the filter wrapping can be in the range of 5% to 15% of the total mass of the filter. A particularly dimensionally stable wrapping of the filter base segments is thus achieved, which ultimately results in a very dimensionally stable filter. It is also conceivable for a high dimensional stability to only be formed in the region of the first filter segment and/or in the region of the recesses or grooves, while the rest of the filter exhibits a lower dimensional stability or a dimensional stability which is comparable to conventional filters.

The invention also relates to a method for manufacturing a filter for smoking products. To this end, a first filter base element is provided with a component to be dispensed to the smoke flow. This is achieved in accordance with the invention by introducing or attaching an element which comprises the component to be dispensed, for example a flavour thread, to the filter base element. A base wrapping can then be attached or adhered around the first filter base element, wherein said base wrapping extends over the circumferential area of the filter base element, thus producing a first filter segment.

The method in accordance with the invention also comprises another step in which a second filter base element is provided with a sorption agent, in particular activated carbon, such that in the region of the second filter base element in the finished filter of the smoking product, at least one undesirable component is sorbed or in particular adsorbed by said sorption agent. Thus, the second filter segment can be provided with activated carbon particles which are arranged in a distribution, in particular in a uniform distribution, in the second filter segment. This second filter segment can then, like the first filter segment, be circumferentially glued to a base wrapping.

The first and second filter segment can then be glued to a common filter wrapping, in particular glued over a large area, and thus combined to form a filter. As already illustrated above, an extremely dimensionally stable wrapping of the filter can then be achieved by these many individual glue connections. An application of glue and/or gum which is more generous than in conventional manufacturing of filters is also beneficial to the dimensional stability of the filter wrapping.

In a subsequent method step, the filter connected in this way can be provided with recesses and/or grooves in the region of the mouth-end filter segment, wherein said recesses and/or grooves are for example uniformly distributed on the circumference of the filter segment and extend parallel to a longitudinal axis of the filter. These grooves can for instance be achieved by rolling the entire filter over an adjustably heated plate at an adjustable bearing pressure, wherein the plate comprises protrusions, which are impressed into the filter material, in a desired geometry. When manufacturing such a multi-filter, it is possible to place a number of filter segments in succession in order to form a so-called filter rod which can ultimately be divided into a number of individual multi-filters. It is thus possible, in order to form the recesses and/or grooves, for the entire filter rod to be rolled over an adjustably heated plate, wherein the recesses and/or grooves are formed on the filter rod at particular intervals, such that after the filter rod has been divided up into individual multi-filters, the grooves are formed at particular, desired locations on each individual multi-filter. Furthermore, it is possible to produce a different number of grooves on the circumference of the filter segment, which can exhibit a particular geometry, depending on requirements. Both the length and depth and also shape of the grooves can be defined as desired, wherein the selection of these parameters depends on the desired specifications of the smoking product. The base wrapping and/or filter wrapping can be glued or gummed over an area, wherein a small partial area preferably remains free in order to gum the seam of the filter wrapping paper to another gum. Said filter treated in this way can then cure for up to 90 hours, such that a filter hardness is achieved which is higher than a standard filter hardness, in particular by a greater application of triacetin in the grooved filter segments, which in this filter segment can be in the range of 7% to 15% of the total mass of the filter.

For manufacturing cigarettes, the filters are cut to length in a known way and connected to the wrapped tobacco rod by a tipping paper. The tipping paper is ventilated in a known way and/or can be ventilated in a known way while manufacturing cigarettes.

A preferred embodiment of the present invention is shown in the following, on the basis of the enclosed FIG. 1. The invention can comprise the features described therein, individually and in any expedient combination.

FIG. 1 shows a filter in accordance with the invention for a smoking product which as a whole is provided with the reference sign 1. A filter 8 is arranged at the end of the smoking product 1 facing the smoker, and in turn comprises the filter segments 2 and 3. The filter segment 2 adjoins the filter outlet opening 4 from which the smoke flow dispensed to the smoker exits the smoking product 1. The filter segment 2 comprises a filter base segment 2*a* made of cellulose acetate tow and a base wrapping 2*b* which is arranged on the circumference of the filter segment 2 and gummed to the filter base element 2*a* over almost the entire cylindrical circumferential area of the first filter segment 2. Three recesses 9, which are distributed uniformly on the circumference of the filter segment 2 and extend parallel to the central longitudinal axis of the smoking product 1, serve to guide the ventilation air and to channel the smoke flow towards the central axis of the filter segment 2, wherein the ventilation air comes from the environment of the smoking product and can enter through ventilation openings which are schematically shown in FIG. 1. The ventilation openings are situated on the circumference of the first filter segment in this preferred embodiment, but can be arranged at any positions along the filter in a known way. The recesses 9 extend from the filter outlet opening 4 of the smoking product up to a central region of the filter segment 2, such that three openings are formed on the area of the filter outlet opening.

On the central longitudinal axis of the smoking product 1, a flavour thread 10 made of cellulose acetate extends from the filter outlet opening 4 up to the boundary area between the first and second filter segments 2 and 3 and contains one or more substances and/or components to be dispensed to the smoke flow, and has in particular been treated with flavouring substances. The smoke flow is advantageously channelled to the centre of the first filter segment 2 and/or into the region of the flavour thread 10 by the recesses 9, such that the smoke flow is optimally impregnated with the component to be dispensed.

The second filter segment 3 is situated adjacent to the first filter segment 2, i.e. between the first filter segment 2 and the smokable material and/or tobacco rod 7 and—like the first filter segment 2—comprises a filter base element 3*a* and a base wrapping 3*b* which is glued over an area in the same way as the first filter segment.

The filter wrapping 8*b* is situated in a circumferential arrangement around the first filter segment 2 and the second filter segment 3 and is glued to the base wrappings 2*b* and 3*b* over an area and combines the first filter segment 2 and the second filter segment 3 to form a filter 8. It can be seen from FIG. 1 that a smoke flow coming from the tobacco rod 7 necessarily has to flow through the filter inlet opening 5 at which the second filter segment 3 adjoins the tobacco rod 7, then passes the second filter segment 3 comprising the activated carbon particles 6 arranged in a distribution within it, and the first filter segment 2 comprising the flavour thread 10, in order to finally exit the smoking product 1 from the filter outlet opening 4.

In order to manufacture the filter in accordance with the invention shown in FIG. 1, the filter base elements 2*a* and 3*a* are each provided with a base wrapping 2*b* and 3*b* by gluing each of the base wrappings 2*b* and 3*b* at the circumference of the corresponding filter base element 2*a* and 3*a*. Prior to this step, the filter base element 2*a* has been provided with a flavour thread 10 which runs on the central longitudinal axis of the filter base element 2*a*, and the filter base element 3*a* has been provided with activated carbon particles 6, which corresponds to known technologies in manufacturing filters.

The filter segments 2 and 3 thus created are then placed axially against each other, wherein a number of the filter segments 2 and 3 can be placed in any order, i.e. in alternating axial succession in this case, in order to be combined to form a filter and/or filter rod by adhering the filter wrapping 8*b*. Following this, the individual filters and/or the filter rod are then rolled over an adjustably heated plate in order to form recesses 9 on the circumference of the first filter segment 2. In the case of a filter rod, this can then be divided into individual filters consisting of the filter segments 2 and 3, wherein the ultimate dimensional stability of the filter can be set by adjusting the application of glue and the triacetin content.

The present invention is shown here on the basis of a filter cigarette, wherein both the filter segments 2 and 3 and the tobacco rod 7 exhibit an elongated cylindrical shape. It is, however, also conceivable for the filter in accordance with the invention to be able to be used in conjunction with other smoking products, for example pipes, and accordingly for it to be able to also exhibit shapes other than cylindrical shapes.

The following table shows the lower limit (in the right-hand column) and the upper limit (in the left-hand column) for preferred parameter values of an embodiment of the present invention.

| | Upper limit | Lower limit |
|---|---|---|
| Filter segments | 4 | 2 |
| Length of tobacco rod | 85 mm | 49 mm |
| Length of filter | 35 mm | 21 mm |
| Mouth-end segment | 25 mm | 12 mm |
| Rod-end segment | 23 mm | 8 mm |
| Number of grooves | 8 | 2 |
| Length of grooves | =length of segment (2) | 3 mm |
| Depth of grooves | 2 mm | 0.4 mm |
| Ventilation | 95% | 10% |
| Charcoal loading | 5.5 mg/mm | 0.5 mg/mm |
| Diameter of flavour thread | 2 mm | 0.5 mm |
| Flavour loading | 7 mg | 0.1 mg |

The invention claimed is:

1. A ventilated filter for a smoking product, filter comprising:

a first filter segment including a filter base element, a base wrapping, and a component, the first filter segment configured to dispense said component to a smoke flow passing through a filter outlet opening;

a second filter segment including a filter base element, a base wrapping, and a sorption agent configured to sorb a smoke flow component from a smoke flow passing through a filter inlet opening; and a filter wrapping which is circumferentially attached to the base wrappings and wherein the filter wrapping and the filter base wrappings form a dimensionally stable wrapping by being glued together over at least one substantial region, at least one of the first filter segment and the second filter segment further including at least one recess defined by an outer surface thereof, and wherein the dimensionally stable wrapping is situated between the at least one recess and a tipping paper connecting the filter to a tobacco rod.

2. The filter according to claim 1, wherein the first filter segment is arranged in a region of the filter that faces away from smokable material of a smoking product, and the second filter segment is arranged in a region of the filter that faces the smokable material of the smoking product.

3. The filter according to claim 1, wherein the first filter segment includes the at least one recess arranged substantially parallel to a longitudinal axis of the first filter segment.

4. The filter according to claim 3, wherein the at least one recess extends from the filter outlet opening to a region that is spaced away from a frontal area of the first filter segment opposite the filter outlet opening.

5. The filter according to claim 1, wherein the first filter segment further includes a region or element comprising the component.

6. The filter according to claim 5, wherein the region or element is elongate and is arranged on the longitudinal axis of the first filter segment.

7. The filter according to claim 1, wherein the sorption agent is an absorption agent or an adsorption agent.

8. The filter according to claim 1, wherein at least one of the base wrappings and is connected to the filter base element in at least one substantial region of a circumferential surface of that filter segment.

9. The filter according to claim 8, wherein a connection between the at least one of the base wrappings and/or the filter wrapping and the filter base element and/or the filter segment, is a glue connection comprising a glue, a mass of the glue being in the range of 5% to 15% of a mass of the filter.

10. The filter according to claim 1, wherein the sorption agent is activated carbon.

11. A method for manufacturing a filter for smoking products, the method comprising:

providing a continuous rod of a first filter base element including a component configured to be dispensed to a smoke flow;

attaching a base wrapping to an outer surface of the continuous rod of the first filter base element, thereby producing a first filter segment;

providing a continuous rod of a second filter base element comprising a sorption agent configured to sorb a smoke flow component from a smoke flow;

attaching a base wrapping to a circumferential area of the continuous rod of the second filter base element, thereby producing a second filter segment;

combining elements of the first filter segment and the second filter segment, each having been correspondingly cut to length, to form a filter rod having a length which is a multiple of a length of a filter, by gluing the base wrappings of the filter segments to a filter wrapping over a large area so as to obtain a dimensionally stable wrapping;

forming at least one recess on the outer circumference of at least one of the first filter segment and the second filter segment; and connecting the filter to a tobacco rod by means of a tipping paper, wherein the dimensionally stable wrapping is disposed between the at least one recess and a tipping paper connecting the filter to a tobacco rod.

12. The method according to claim 11, wherein the first filter base element and the second filter base element are glued to a base wrapping over a first area and glued to a filter wrapping over a second area.

13. The method according to claim 11, wherein the gluing includes applying a quantity of the glue having a mass in the range of 7% to 15% of a mass of the filter.

14. The method according to claim 11, wherein forming the at least one recess on the outer circumference of at least one of the first filter segment and the second filter segment includes rolling the at least one of the first filter segment and the second filter segment over an element comprising protrusions, at a predetermined bearing pressure, thereby producing circumferential recesses in a region of the first filter segment.

15. The method of claim 11, wherein the sorption agent is activated carbon.

* * * * *